US005927115A

United States Patent [19]

Feder

[11] Patent Number: 5,927,115

[45] Date of Patent: Jul. 27, 1999

[54] PICK-RESISTANT LOCK SYSTEM AND METHOD

[76] Inventor: George N. Feder, 206 22nd Ave., Apt. #3, Indian Rocks Beach, Fla. 33785

[21] Appl. No.: 09/095,377

[22] Filed: Jun. 10, 1998

[51] Int. Cl.[6] ..... E05B 15/00

[52] U.S. Cl. ..... 70/419; 70/423; 70/453

[58] Field of Search ..... 70/419, 417, 375, 70/453, 454, 423

[56] References Cited

U.S. PATENT DOCUMENTS

| | | | |
|---|---|---|---|
| Re. 29,277 | 6/1977 | Harrington et al. | 70/311 |
| 2,007,143 | 7/1935 | Keil | 70/419 |
| 3,736,780 | 6/1973 | Singer | 70/453 |
| 4,074,552 | 2/1978 | Smith | 70/417 |
| 4,160,368 | 7/1979 | Solow | 70/417 |
| 4,404,824 | 9/1983 | Hennessy | 70/419 |
| 4,490,998 | 1/1985 | Wellekens | 70/419 |
| 4,530,223 | 7/1985 | Oliver | 70/417 |
| 4,638,652 | 1/1987 | Morse et al. | 70/454 |
| 4,741,188 | 5/1988 | Smith | 70/383 |
| 5,063,765 | 11/1991 | Squire et al. | 70/423 |
| 5,070,716 | 12/1991 | Whorlow | 70/419 |

*Primary Examiner*—Steven Meyers
*Assistant Examiner*—Stephen Grady

[57] ABSTRACT

A pick-resistant lock system including an essentially cylindrical housing with an axial cylindrical bore and a plurality of radial bores spaced along the cylindrical bore and constituting a pin chamber, the radial bores having open ends in communication with the axial bore; a rotatable main cylinder rotatably located within the axial bore, the man cylinder having radial bores alignable with the radial bores of the housing and a planar key way alignable with the radial bores when in the locked orientations; a plurality of pins formed of plural segments positionable within the radial bores of the housing and main cylinder and with springs urging the pins toward the key way, the segments of the pins having interfaces which are alignable with the interface between the bores of the main cylinder and housing; a generally cylindrical facing cylinder axially alignable with the main cylinder and freely rotatable with respect thereto, the facing cylinder having an enlargement matable with a complementary recess in the housing, the facing cylinder also having an introductory key way alignable with the key way of the main cylinder for receiving a key, and a cam secured to the face of the main cylinder remote from the facing cylinder for effecting the unlocking of the lock upon rotation of the cylinder and cam by rotation of a key.

1 Claim, 3 Drawing Sheets

FIG 3
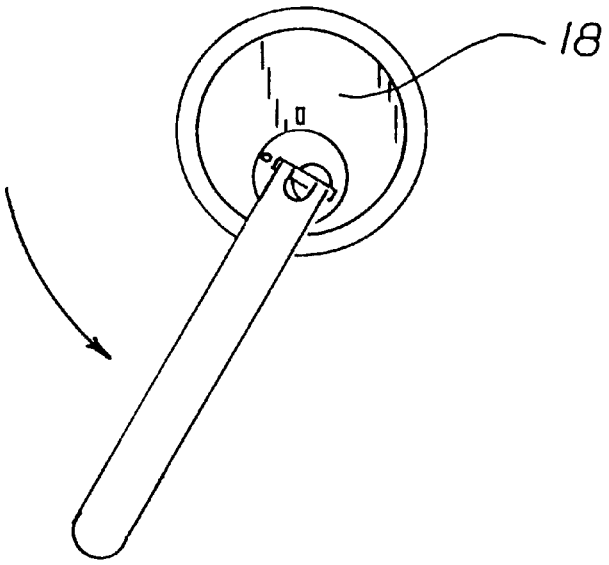
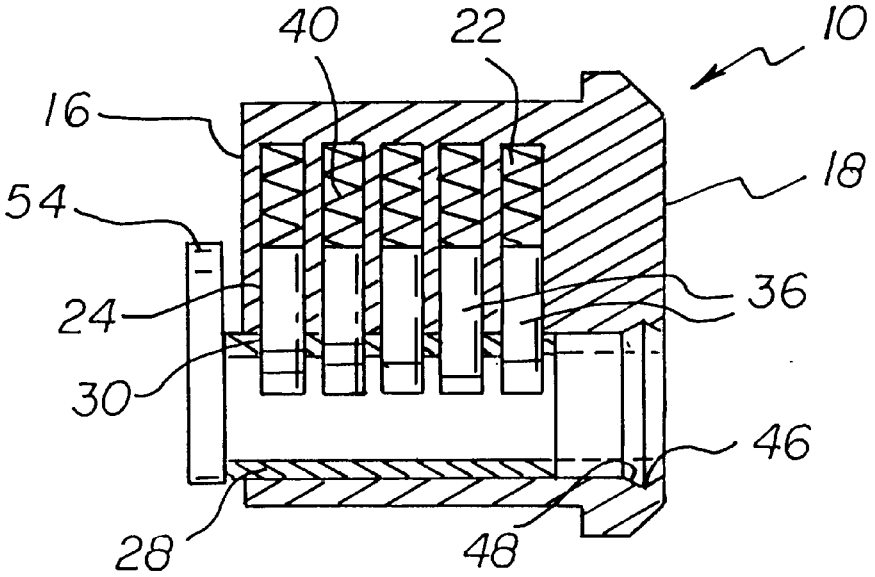
FIG 4

FIG 5
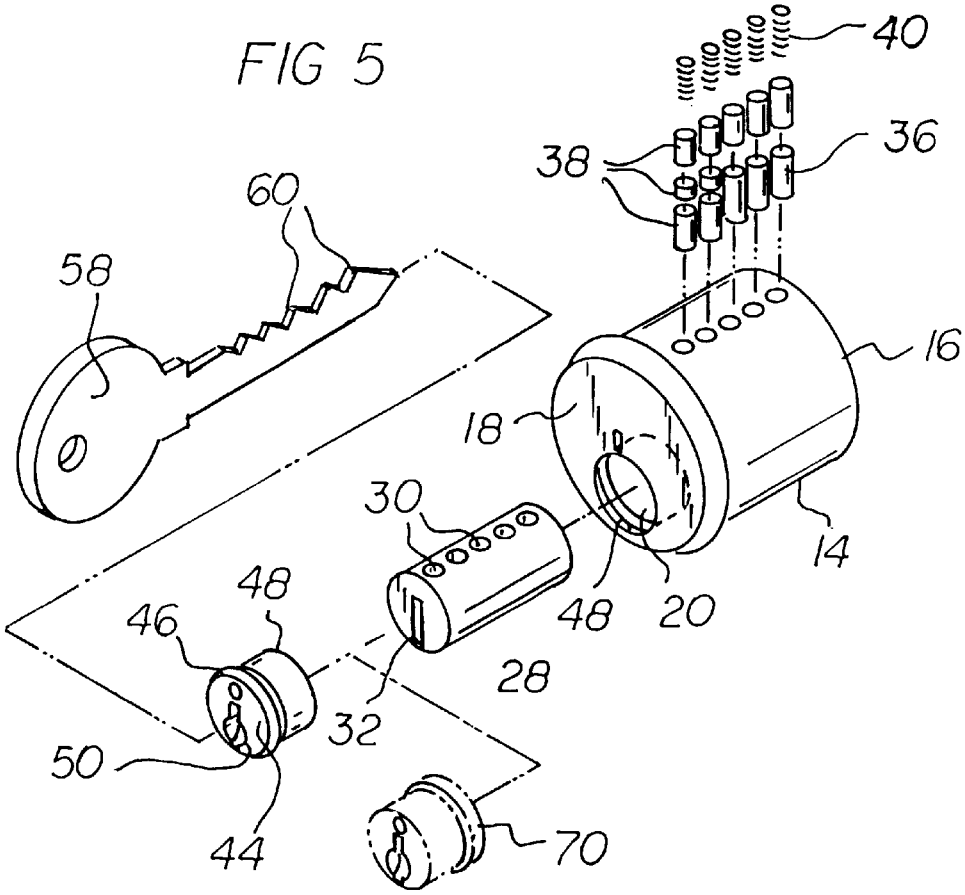
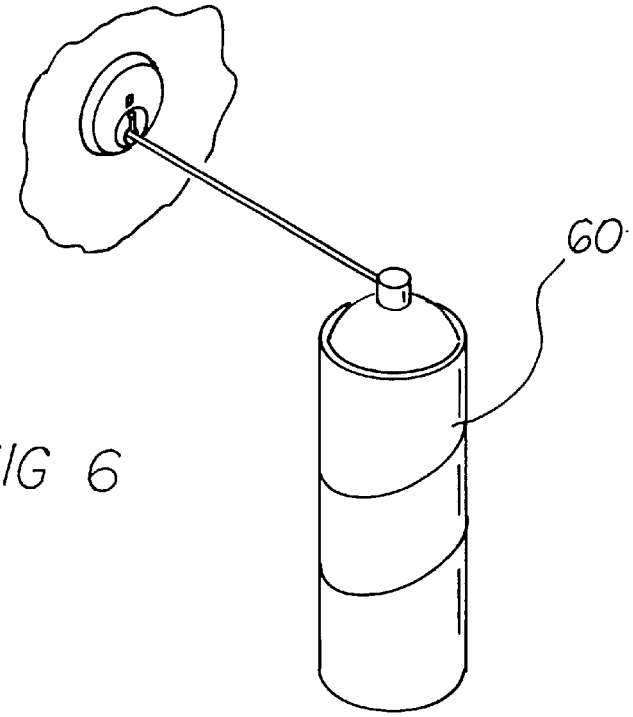
FIG 6

PICK-RESISTANT LOCK SYSTEM AND METHOD

BACKGROUND OF THE INVENTION

1. Field of the Invention

The present invention relates to a Pick-Resistant Lock System and Method and more particularly pertains to abating the friction between lock pins and their supporting bores for thereby precluding the opening of the lock without a key.

2. Description of the Prior Art

The use of locks of known designs and configurations are known in the prior art. More specifically, locks of known designs and configurations heretofore devised and utilized for the purpose of minimizing the possibility of opening locks without keys are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 1,414,348 to M. Falk discloses a pin-tumbler lock. U.S. Pat. No. 3,478,549 to E. L. Schlage discloses a pick resistant lock unit. U.S. Pat. No. 3,531,959 to E. Weber discloses a security attachment for cylinder lock. U.S. Pat. No. 4,103,526 to Surko, Jr. discloses a pin tumbler lock. U.S. Pat. No. 4,631,941 to Sjunnesson discloses a cylinder lock with permissible service entry. U.S. Pat. No. 4,953,375, to Tzou discloses an electronically self-latching cylinder lock. U.S. Pat. No. 5,361,614, to Metcalf discloses a pin-tumbler lock with retained key and method of operation thereof. U.S. Pat. No. 5,400,629 to Myers discloses an axial pin tumbler lock. U.S. Pat. No. 5,640,865 to Widen discloses a cylinder lock and key combination. Lastly, U.S. Pat. No. 5,475,997 to Chung discloses a lock assembly.

While these devices fulfill their respective, particular objectives and requirements, the aforementioned patents do not describe a Pick-Resistant Lock System and Method that allows abating the friction between lock pins and their supporting bores for thereby precluding the opening of the lock without a key.

In this respect, the Pick-Resistant Lock System and Method according to the present invention substantially departs from the conventional concepts and designs of the prior art, and in doing so provides an apparatus primarily developed for the purpose of abating the friction between lock pins and their supporting bores for thereby precluding the opening of the lock without a key.

Therefore, it can be appreciated that there exists a continuing need for a new and improved Pick-Resistant Lock System and Method which can be used for abating the friction between lock pins and their supporting bores for thereby precluding the opening of the lock without a key. In this regard, the present invention substantially fulfills this need.

SUMMARY OF THE INVENTION

In view of the foregoing disadvantages inherent in the known types of locks of known designs and configurations now present in the prior art, the present invention provides an improved Pick-Resistant Lock System and Method. As such, the general purpose of the present invention, which will be described subsequently in greater detail, is to provide a new and improved Pick-Resistant Lock System and Method and method which has all the advantages of the prior art and none of the disadvantages.

To attain this, the present invention essentially comprises a new and improved pick-resistant lock system for abating the friction between lock pins and their supporting bores for precluding the opening of the lock without a key comprising, in combination: an essentially cylindrical housing having an interior end and an exterior end with an axial cylindrical bore and a plurality of radial bores spaced along the cylindrical bore and constituting a pin chamber, the radial bores having open ends in communication with the axial bore; a rotatable main cylinder rotatably located within the axial bore, the main cylinder having radial bores alignable with the radial bores of the housing and a planar key way alignable with the radial bores when in the locked orientation; a plurality of pins formed of plural segments positionable within the radial bores of the housing and main cylinder and with springs urging the pins toward the key way, the segments of the pins having interfaces which are alignable with the interface between the bores of the main cylinder and housing; a generally cylindrical facing cylinder axially alignable with the main cylinder and freely rotatable with respect thereto, the facing cylinder having an annular enlargement matable with a complementary recess in the housing, the facing cylinder also having an introductory key way alignable with the key way of the main cylinder for receiving a key; a cam secured to the face of the main cylinder remote from the facing cylinder for effecting the unlocking of the lock upon rotation of the cylinder and cam by rotation of a key; a key having an edge with undulations adapted to enter the key ways when the key ways are aligned to selectively move the pins away from the key to an unlocking orientation with the interfaces of the pins aligned with the interfaces of the main cylinder and housing; and alignment marks on the faces of the main cylinder and facing cylinder to indicate the alignment of the key ways whereby rotation of the facing cylinder as by a tension bar will not effect the rotation of the main cylinder to thereby preclude the creation of friction forces between the pins and the bores which would otherwise allow a pick to raise the pins and allow the opening of the lock without a key.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved Pick-Resistant Lock System and Method which has all of the advantages of the prior art locks of known designs and configurations and none of the disadvantages.

It is another object of the present invention to provide a new and improved Pick-Resistant Lock System and Method which may be easily and efficiently manufactured and marketed.

It is further object of the present invention to provide a new and improved Pick-Resistant Lock System and Method which is of durable and reliable constructions.

An even further object of the present invention is to provide a new and improved Pick-Resistant Lock System and Method which is susceptible of a low cost of manufacture with regard to both materials and labor, and which accordingly is then susceptible of low prices of sale to the consuming public, thereby making such Pick-Resistant Lock System and Method economically available to the buying public.

Even still another object of the present invention is to provide a Pick-Resistant Lock System and Method for abating the friction between lock pins and their supporting bores for thereby precluding the opening of the lock without a key.

Lastly, it is an object of the present invention to provide a new and improved pick resistant lock system comprising: an essentially cylindrical housing having an interior end and an exterior end with an axial cylindrical bore and a plurality of radial bores spaced along the cylindrical bore and constituting a pin chamber, the radial bores having open ends in communication with the axial bore; a rotatable main cylinder rotatably located within the axial bore, the main cylinder having radial bores alignable with the radial bores of the housing and a planar key way alignable with the radial bores when in the locked orientation; a plurality of pins formed of plural segments positionable within the radial bores of the housing and main cylinder and with springs urging the pins toward the key way, the segments of the pins having interfaces which are alignable with the interface between the bores of the main cylinder and housing; a generally cylindrical facing cylinder axially alignable with the main cylinder and freely rotatable with respect thereto, the facing cylinder having an enlargement matable with a complementary recess in the housing, the facing cylinder also having an introductory key way alignable with the key way of the main cylinder for receiving a key; a cam secured to the face of the main cylinder remote from the facing cylinder for effecting the unlocking of the lock upon rotation of the cylinder and cam by rotation of a key: a key having an edge with undulations adapted to enter the key ways when the key ways are aligned to selectively move the pins away from the key to an unlocking orientation with the interfaces of the pins aligned with the interfaces of the main cylinder and housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description make reference to the annexed drawings wherein:

FIG. 3 is a view similar to FIG. 2 but illustrating the tension bar within the lock being rotated to preclude the picking of the lock.

FIG. 4 is a cross-sectional view taken along line 4—4 of FIG. 1.

FIG. 5 is an exploded perspective view of the system shown in the prior Figures.

FIG. 6 illustrates an alternate embodiment of the present invention.

The same reference numerals refer to the same parts through the various Figures.

DESCRIPTION OF THE PREFERRED EMBODIMENT

Figure 1:
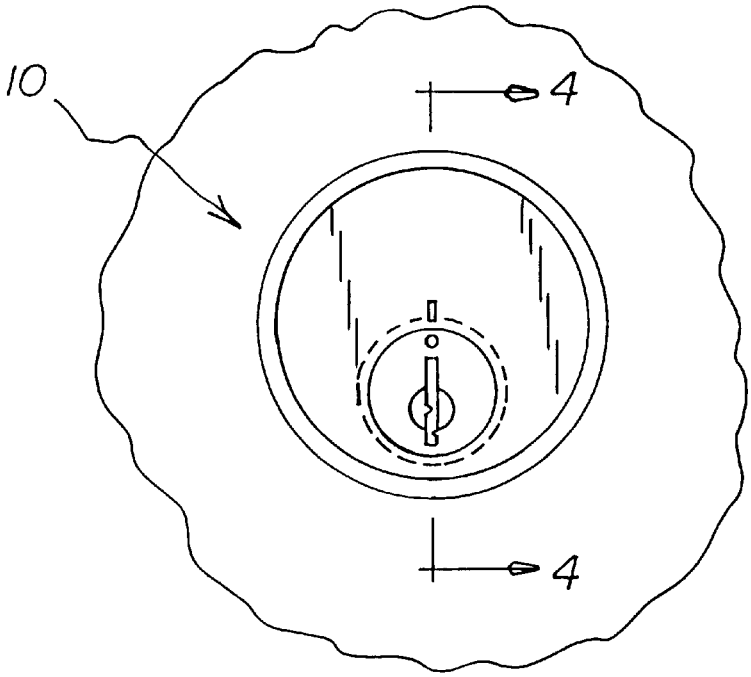
FIG. 1 a front elevational view of the new and improved Pick-Resistant Lock System constructed in accordance with the principles of the present invention.
Figure 2:
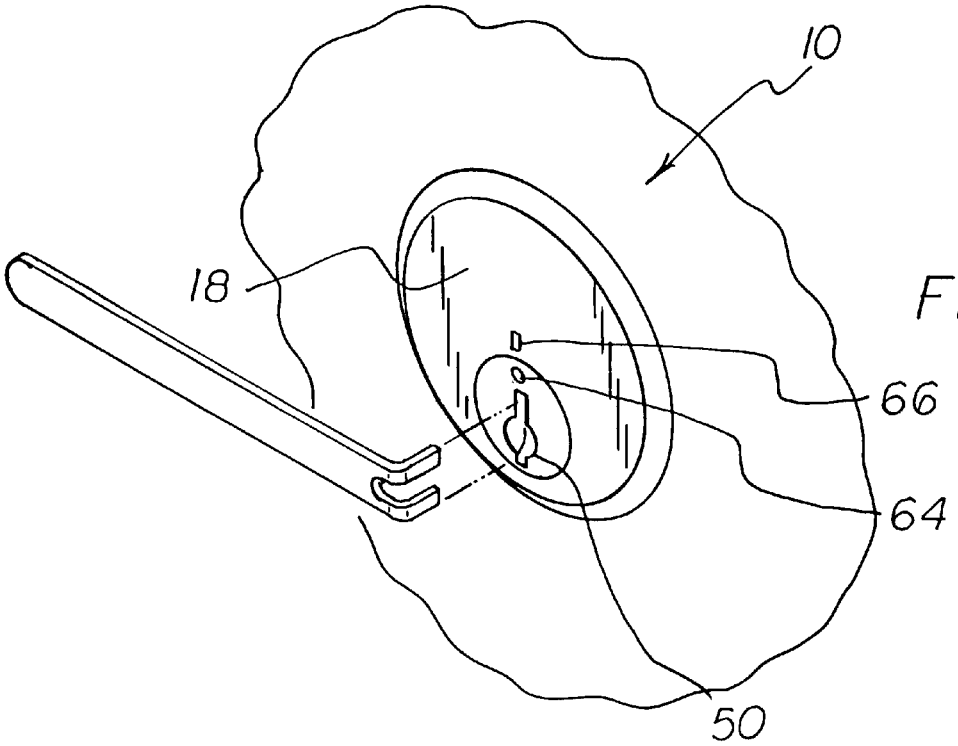
FIG. 2 is a perspective view of the apparatus as shown in FIG. 1 illustrating a lock tension bar which might otherwise be used for picking the lock.

With reference now to the drawings, and in particular to FIG. 1 thereof, the preferred embodiment of the new and improved Pick-Resistant Lock System and Method embodying the principles and concepts of the present invention and generally designated by the reference numeral 10 will be described.

The present invention relates to a new and improved pick-resistant lock system (10) which functions for abating the friction between lock pins and their supporting bores. This precludes the opening of the lock without a key comprising, in combination:

The central component of the system is an essentially cylindrical housing (14) having an interior end (16) and an exterior end (18). It also has an axial cylindrical bore (20) and a plurality of radial bores (22). The radial bores are spaced along the cylindrical bore and constitute a pin chamber. In addition, the radial bores have open ends (24) in communication with the axial bore.

A rotatable main cylinder (28) is next provided. Such cylinder is rotatably located within the axial bore. The main cylinder has radial bores (30). The bores are alignable with the radial bores of the housing. Further, a planar key way (32) is provided to be alignable with the radial bores when in the locked orientation.

Next provided are a plurality of pins (36) formed of plural segments (38). The segments are positionable within the radial bores of the housing and main cylinder and have springs (40) urging the pins toward the key way. The segments of the pins have interfaces which are alignable with the interface between the bores of the main cylinder and housing.

Next provided is a generally cylindrical facing cylinder (44). The cylinder is axially alignable with the main cylinder and freely rotatable with respect thereto. The facing cylinder has an annular enlargement (46) matable with a complementary recess (48) in the housing. The facing cylinder also has an introductory key way (50). This key way is alignable with the key way of the main cylinder for receiving a key.

Next provided is a cam (54) secured to the face of the main cylinder remote from the facing cylinder for effecting the unlocking of the lock upon rotation of the cylinder and cam by rotation of a key.

Next provided is a key (58) having an edge with undulations (60) adapted to enter the key ways when the key ways are aligned to selectively move the pins away from the key to an unlocking orientation with the interfaces of the pins aligned with the interfaces of the main cylinder and housing.

Alignment marks (64, 66) on the faces of the main cylinder and facing cylinder indicate the alignment of the key ways whereby rotation of the facing cylinder as by a tension bar will not effect the rotation of the main cylinder. The creation of friction forces between the pins and the bores are thereby precluded which would otherwise allow a pick to raise the pins and allow the opening of the lock without a key.

An alternate embodiment of the invention is shown in FIG. 5. In such embodiment, the enlargement (70) is annular and located at the end of the cylinder adjacent to the main cylinder. Note the dotted line showing of FIG. 5.

The invention also includes a pick-resistant lock method for abating the friction between lock pins and their supporting bores. This again is for precluding the opening of the lock without a key comprising, in combination:

The first step is providing an essentially cylindrical housing (14) having an interior end (16) and an exterior end (18) with an axial cylindrical bore (20) and a plurality of radial bores (22) spaced along the cylindrical bore and constituting a pin chamber, the radial bores having open ends (24) in communication with the axial bore.

The second step is providing a rotatable main cylinder (28) rotatably located within the axial bore, the main cylinder having radial bores (30) alignable with the radial bores of the housing and a planar key way (32) alignable with the radial bores when in the locked orientation.

The third step is providing a plurality of pins (36) formed of plural segments (38) positionable within the radial bores of the housing and main cylinder and with springs (40) urging the pins toward the key way, the segments of the pins having interfaces which are alignable with the interface between the bores of the main cylinder and housing;

The fourth step is providing a cam (54) secured to the face of the main cylinder remote from the facing cylinder for effecting the unlocking of the lock upon rotation of the cylinder and cam by rotation of a key;

The fifth step is providing a key (58) having an edge with undulations (60) adapted to enter the key ways when the key ways are aligned to selectively move the pins away from the key to an unlocking orientation with the interfaces of the pins aligned with the interfaces of the main cylinder and housing.

The sixth step is providing alignment marks (64, 66) on the faces of the main cylinder and facing cylinder to indicate the alignment of the key ways whereby rotation of the facing cylinder as by a tension bar will not effect the rotation of the main cylinder to thereby preclude the creation of friction forces between the pins and the bores which would otherwise allow a pick to raise the pins and allow the opening of the lock without a key.

The final step is abating the friction forces between the pins and their supporting bores whereby moving the pins as by a pick will preclude the retention of the pins in an unlocking orientation against the action of the springs.

In one embodiment, the final step is effected by a generally cylindrical facing cylinder (44) axially alignable with the main cylinder and freely rotatable with respect thereto, the facing cylinder having an enlargement (46) matable with a complementary recess (48) in the main cylinder, the facing cylinder also having an introductory key way (50) alignable with the key way of the main cylinder for receiving a key.

In an alternate embodiment, the final step is effected by a lubricating fluid injected into the lock to coat the interfaces between the pins and their bores.

In the alternate embodiment, the lubricating fluid, preferably includes an aliphatic hydrocarbon, a water-displacing compound, a lubricant (60), a fragrance, and a propellant, the lubricant being poly tetrafluoroethylene, the lubricant constituting at least 50 percent by weight of the content of the lubricating fluid.

The present lubricating fluid will make any pin-tumbler cylinder lock virtually impossible to pick pin-tumbler cylinder locks are the most widely used style of lock for security in residential and commercial buildings at the present time. The present lubricating fluid is a superior lubricating substance. It will protect the moving parts inside the lock cylinder. It will enhance the lifetime of the lock and help insure that the lock works efficiently as it was intended with the proper key. By inserting the present lubricating fluid into the lock cylinder through the opening made for the key and then gently massaging it in the cylinder so that it coats all moving parts, the lock now becomes virtually impossible to pick.

The present lubricating fluid works in the following fashion. In order to pick a lock a tension bar and a pick must be used. The right amount of pressure must then be applied on the cylinder core with a tension tool. Then, a pick must be used to move each individual pin up to the shear line in the cylinder. When all the pins have reached the shear line, the lock will open.

The present lubricating fluid will prevent the tension bar and pick from operating properly. The present lubricating fluid will not allow the pins to remain at the proper level with the shear line, therefore the lock will not open without the proper key.

The above is accomplished because the ingredients in the present lubricating fluid coat all parts inside the lock cylinder making these parts too slippery to be manipulated properly with a tension bar and lock pick. Only the proper key made for the specific lock will place the pins at the proper position, therefore opening the lock.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved pick-resistant lock system for abating the friction between lock pins and their supporting bores for precluding the opening of the lock without a key comprising, in combination:

an essentially cylindrical housing having an interior end and an exterior end with a single continuous axial cylindrical bore and a plurality of radial bores spaced along the cylindrical bore and constituting a pin chamber, the radial bores having open ends in communication with the axial bore with an annular recess adjacent to the exterior end;

a rotatable main cylinder having a first diameter along its length and rotatably located completely within the axial bore remote from the exterior end, the main cylinder having radial bores alignable with the radial bores of the housing and a planar key way alignable with the radial bores when in the locked orientation, and the main cylinder is only rotatable with a key;

a plurality of pins formed of plural segments positionable within the radial bores of the housing and main cylinder and with springs urging the pins toward the key way, the segments of the pins having interfaces which are alignable with the interface between the bores of the main cylinder and housing;

a generally cylindrical facing cylinder having a diameter equal to the first diameter along the majority of its length and located within the axial bore adjacent the exterior end axially alignable with the main cylinder and freely rotatable with respect thereto, the facing cylinder having an annular enlargement matable with the complementary annular recess in the housing, the facing cylinder also having an introductory key way alignable with the key way of the main cylinder for receiving a key, and freely rotatable at all times;

a cam secured to the face of the main cylinder remote from the facing cylinder for effecting the unlocking of the lock upon rotation of the cylinder and cam by rotation of a key;

a key having an edge with undulations adapted to enter the key ways when the key ways are aligned to selectively move the pins away from the key to an unlocking orientation with the interfaces of the pins aligned with the interfaces of the main cylinder and housing; and alignment marks on the faces of the main cylinder and facing cylinder to indicate the alignment of the key ways whereby rotation of the facing cylinder as by a tension bar will not effect the rotation of the main cylinder to thereby preclude the creation of friction forces between the pins and the bores which would otherwise allow a pick to raise the pins and allow the opening of the lock without a key.

* * * * *